United States Patent [19]

Seto et al.

[11] Patent Number: 5,060,498

[45] Date of Patent: Oct. 29, 1991

[54] SECTION STEEL STRAIGHTENER WITH ADJUSTABLE ROLLER WIDTH

[75] Inventors: Tsuneo Seto; Atsushi Hatanaka; Hironori Miura; Hideo Baba, all of Kurashiki, Japan

[73] Assignee: Kawasaki Steel Corporation, Hyogo, Japan

[21] Appl. No.: 573,236

[22] Filed: Aug. 28, 1990

[51] Int. Cl.[5] ..... B21D 3/04; B21B 1/12

[52] U.S. Cl. ..... 72/164; 72/160; 72/224; 72/247

[58] Field of Search ..... 72/247, 224, 225, 164, 72/160, 180; 29/124, 125

[56] References Cited

U.S. PATENT DOCUMENTS

| | | | |
|---|---|---|---|
| 234,365 | 11/1880 | Wilson | 72/180 |
| 1,926,830 | 9/1933 | Yates | 72/247 |
| 4,748,729 | 6/1988 | Rochelmeyer | 29/125 |

FOREIGN PATENT DOCUMENTS

| | | | |
|---|---|---|---|
| 119302 | 6/1986 | Japan | 72/247 |
| 262407 | 11/1986 | Japan | 72/247 |
| 156007 | 7/1987 | Japan | 72/247 |
| 299710 | 12/1989 | Japan | 72/247 |

*Primary Examiner*—Daniel C. Crane
*Attorney, Agent, or Firm*—Oliff & Berridge

[57] ABSTRACT

A section steel straightener for correcting deformations in section steel, such as H-beams. The straightener allows for adjusting the width of the rollers without disassembling the apparatus, but rather by rotating sleeves to change the distance between rollers. Also disclosed is a plurality of rollers forming at least one of the fixed roller and movable roller such that the required amount of movement of the movable roller is reduced, thereby reducing idle time of the straightener.

2 Claims, 7 Drawing Sheets

SECTION STEEL STRAIGHTENER WITH ADJUSTABLE ROLLER WIDTH

BACKGROUND OF THE INVENTION

1. Field of the Invention

This invention relates to an improvement in a straightener for correcting deformation of section steel, and more particularly, to a section steel straightener capable of an on-line adjustment of its roller width.

2. Description of the Prior Art

Section Steel, such as H-beams, are often rolled and shaped by hot rolling. Upon cooling, deformities in the section steel that may arise, can be corrected with a roller straightener. As can be seen in FIG. 5, an H-beam has flanges 1 and a web 2 with different thicknesses. There is a temperature difference between the flanges 1*a* and 1*b*. Therefore, in a cooling step after the rolling process, the flanges 1 and the web 2 are cooled at different cooling rates, as shown in FIG. 6. Thus, when the H-beam is cooled to normal temperature, deformations such as bending (FIG. 7(*a*)), warp (FIG. 7(*b*)), angular deformation (FIG. 7(*c*)), etc., can arise. H-beams with such deformation have no commercial value, and therefore, must be corrected. For correcting these deformations, a roller straightener shown in FIG. 8(*a*) or a press straightener shown in FIG. 8(*b*) are generally used. In a roller straightener as shown in FIG. 8(*a*), the end faces of the rollers are disposed in contact with the inner surfaces of the flanges of an H-beam or are arranged close thereto with a small gap therebetween. The rollers are pressed against the web surfaces to repeatedly impart a bending load thereto along the length of the H-beam. With the bending load gradually reduced, the deformation of the H-beam is corrected.

In the conventional roller straightener, however, in order to set the straightener roller width to the inner width Hw of an H-beam to be straightened (FIG. 9), the distance between a drive-side roller 6 and an operation-side roller 7 must be changed to thereby vary the straightener roller width.

When changing the straightener roller width in conventional apparatus, a master sleeve nut 4 and then a master sleeve 5 are detached, and a roller clamping nut 8 removed. Then, after the operation-side roller 7 is detached, threaded members 9 and 9*a* are suitably adjusted to set the straightener roller width to a predetermined width. After this, the drive-side roller 6 and the threaded members 9 and 9*a* are fitted onto the master sleeve 5, and the operation-side roller 7 is fixed by the roller clamping nut 8. After the master sleeve 5 is fitted onto the spindle 3, the sleeve 5 is fixed by the master sleeve clamping nut 4, thereby completing the adjusting operation.

The entire process of the roller width adjustment in the conventional straightener requires about 20 to 30 minutes. This adjustment is usually needed about 50 times a month, depending on the size of H-beams to be straightened and the frequency of straightening process. Therefore, about 1,000 to 1,500 minutes per month may be consumed for the roller width adjustment, which interfaces with the straightening operation and lowers productivity.

Conventional H-beams generally have identical inter-flange width Hw and are different only in the flange thickness. But, with recent remarkable developments in the method of producing H-beams by the rolling process, H-beams having the same outer width Ho but different inner widths Hw, which depend on the thicknesses of flanges which were formerly assembled by welding, can now be produced by hot rolling. Such beams are generally called H-beams with constant external dimensions. These H-beams, even though referred to by the same dimensions, include a wide variety of types according to the thickness of flanges. Since the inner dimension (roller width) Hw is dependent on the thickness of the flanges, the frequency of the roller width adjustment is increased several times, compared to a conventional case, thus impeding the straightening operation, significantly lowering productivity, and requiring much effort to carry out the roller width adjustment.

OBJECTS AND SUMMARY OF THE INVENTION

While conventional roller straighteners can be adjusted to correct section steel of different widths, a straightener is needed that allows for quick and efficient width adjustment so that straightening operation idle time is significantly reduced.

Accordingly, one object of the present invention is to provide a section steel straightener with adjustable roller width in which the straightening roller width can be quickly and easily adjusted.

Another object of the present invention is to provide a section steel straightener in which the straightening roller width can be easily adjusted with the rollers attached to the spindle, thus increasing productivity, and lowering the cost of equipment.

Yet another object of the present invention is to provide a section steel straightener with a plurality of rollers used for at least one of the fixed roller and movable roller, such that the total amount of movement of the movable roller can be reduced, thus reducing the total roller width adjustment time.

This invention relates to a section steel straightener with adjustable roller width in which a fixed roller and a movable roller, having an identical outer diameter, are coaxially juxtaposed in an axial direction of the apparatus, and which comprises:

(1) a spindle for rotating the fixed roller and the movable roller;

(2) a first sleeve, which is disposed around the spindle with a coupling key therebetween and on which the fixed roller is mounted, for transmitting driving torque from the spindle to the fixed roller;

(3) a second sleeve, which is disposed around the first sleeve with a coupling and guiding key therebetween and on which the movable roller is mounted, for transmitting the driving torque from the spindle to the movable roller;

(4) a sleeve pressing hollow shaft disposed around a support shaft extending from one end of the spindle and fixed to the support shaft, for prohibiting a movement of the first sleeve in the axial direction;

(5) a screw sleeve rotatably disposed around the sleeve pressing shaft and having a thread formed on a surface thereof;

(6) a movable nut having rotation preventing means screwed to the screw sleeve, and coupled to one end of the second sleeve; and (7) a rotating device for rotating the screw sleeve, to move the second sleeve back and forth in the axial direction via the movable nut and the coupling and guiding key.

Preferably, at least one of the fixed roller and the movable roller comprises a plurality of rollers, whereby the shift amount of the movable roller is reduced, thus making it possible to reduce the size of the shifting device and to reduce the cost of equipment.

Since the apparatus of this invention is constructed as described above, the distance between the fixed roller and the movable roller (i.e., the straightener roller width) can be easily adjusted in accordance with the inner width Hw of an H-beam to be corrected. Accordingly, if H-beams with different inner widths Hw are to be corrected, the ordinary straightening operation is not impeded and thus the productivity is not lowered due to lengthy roller width adjustment of the straightener. In addition, an operator need not perform a roller width adjustment involving disassembling and assembling of rollers, as required in conventional systems.

Moreover, by using a plurality of rollers for at least one of the fixed roller and the movable roller, the amount of movement of the movable roller can be reduced, as compared to the case of using only one roller for each of the fixed roller and the movable roller, whereby the time required for the roller width adjustment is shortened.

BRIEF DESCRIPTION OF THE DRAWINGS

The invention will be described with reference to the attached figures wherein:

FIG. 8(*b*) is a diagram illustrating a straightening operation of a press straightener.

DETAILED DESCRIPTION OF THE PREFERRED EMBODIMENTS

Figure 1:
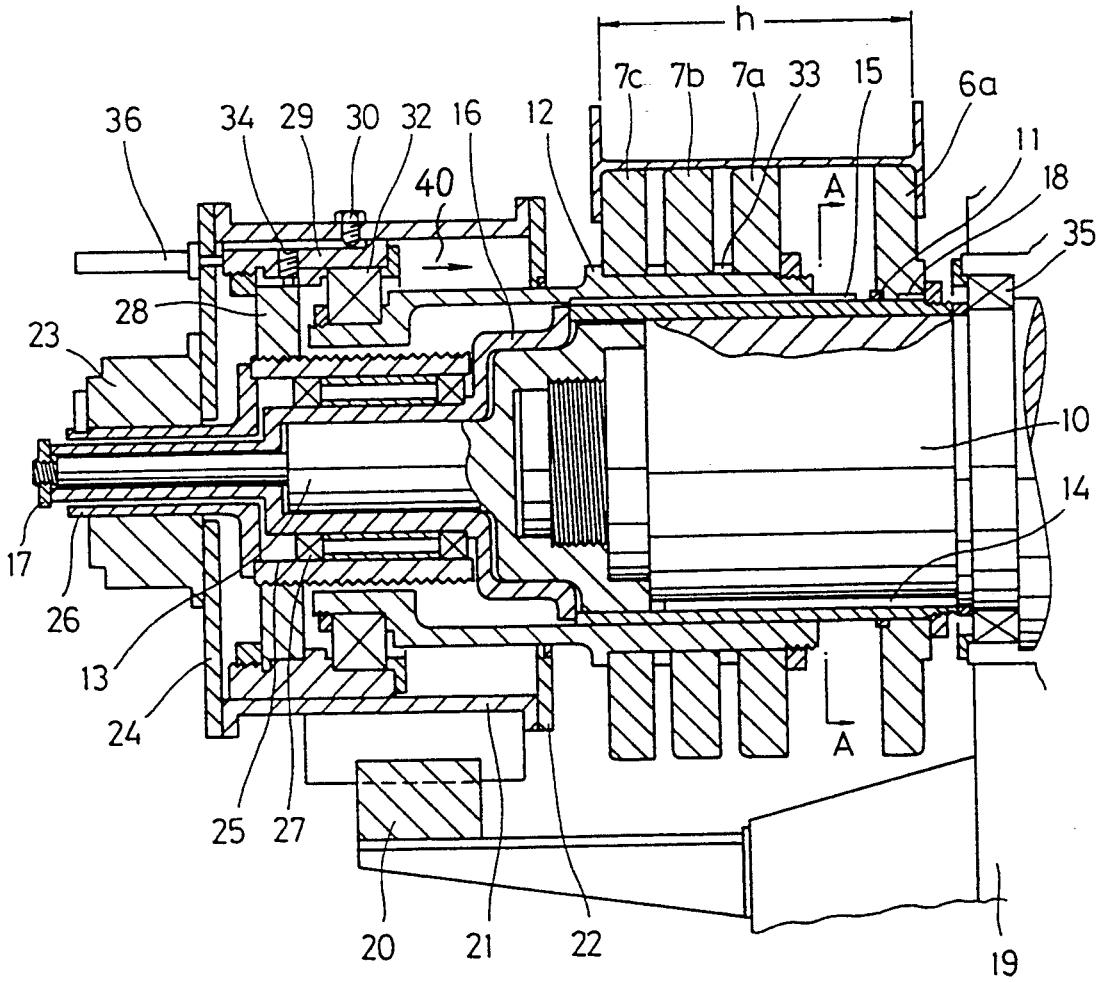
FIG. 1 is a partly sectional front view illustrating lower straightening rollers.
Figure 2:
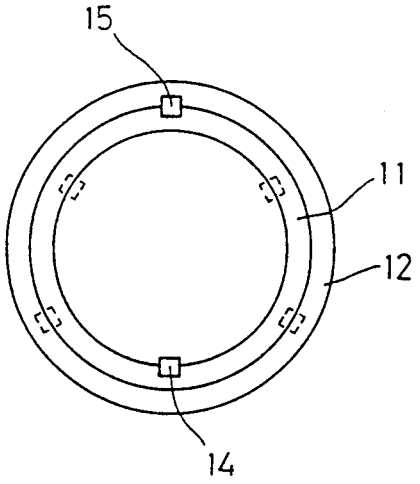
FIG. 2 is a sectional view taken along line A—A in FIG. 1.
Figure 3:
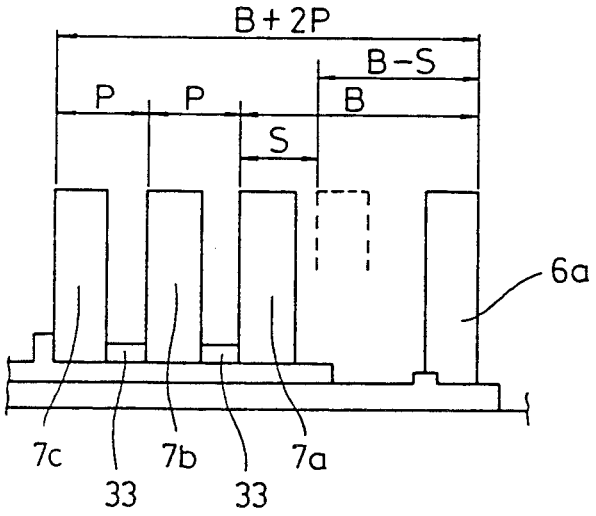
FIG. 3 is a diagram illustrating a roller width adjusting operation.

Embodiments of this invention will be now described with reference to the drawings. FIGS. 1 to 3 are diagrams illustrating one embodiment of the invention, wherein FIG. 1 is a side view showing lower straightening rollers, FIG. 2 is a sectional view taken along line A—A in FIG. 1, and FIG. 3 is a diagram illustrating a roller width adjusting operation.

Figure 8A:
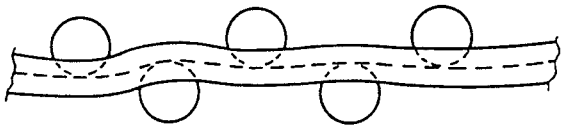
FIG. 8(*a*) is a diagram illustrating a straightening operation of a roller straightener.
Figure 8B:
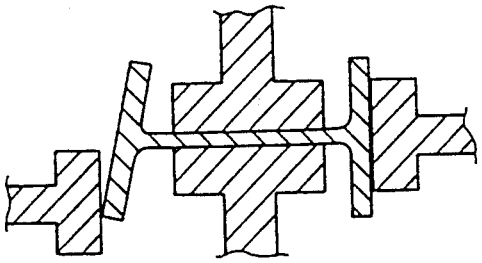
Figure 9:
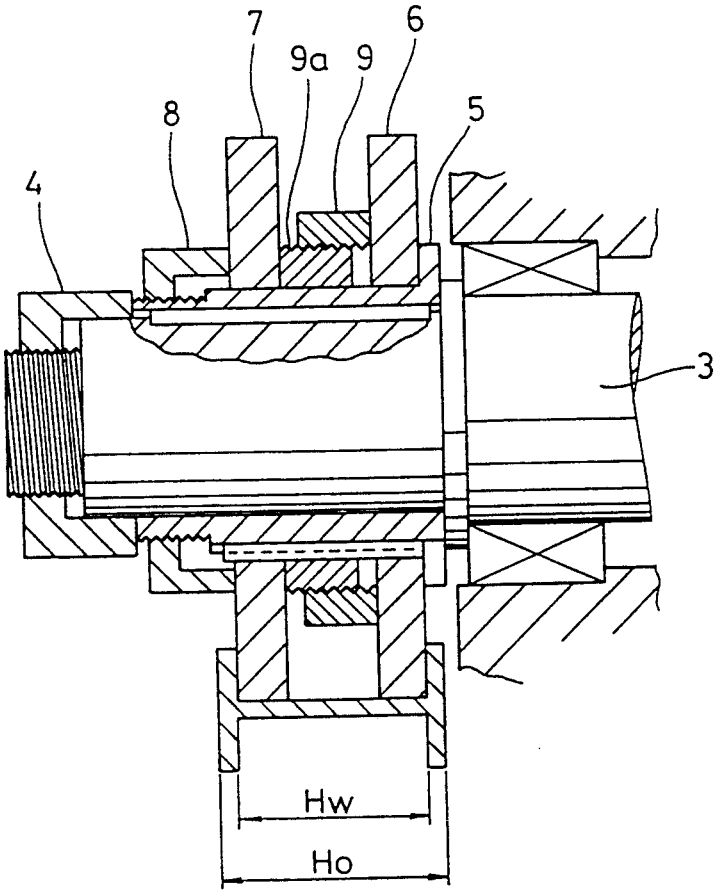
FIG. 9 is a front view, partly in section, of a prior art apparatus.

In roller straighteners for section steel, upper and lower straightening rollers are alternately arranged, as shown in FIG. 8(*a*), but in FIG. 1, only lower straightening rollers are illustrated and three movable rollers are used. Reference numeral 10 denotes a spindle for rotating a fixed roller 6*a* and movable rollers 7*a*, 7*b* and 7*c*. A plurality of movable rollers are provided in order to reduce the amount of movement thereof, and more than two movable rollers are not used at a time. The spindle 10 is mounted to a frame 19 of the straightener via a bearing 35 and other unillustrated bearings. A first sleeve 11 carrying the fixed roller 6*a* thereon is disposed around the spindle 10, and a second sleeve 12 carrying the movable rollers 7*a*, 7*b* and 7*c* thereon is disposed around the first sleeve 11.

The second sleeve 12 is axially movable relative to the first sleeve 11. A support shaft 13, to which a driving means for axially sliding the second sleeve 12 is attached, is screwed to one end of the spindle 10.

The spindle 10 and the first sleeve 11 are coupled to each other by a coupling key 14, and the first and second sleeves 11 and 12 are coupled to each other by a coupling and guiding key 15, so that torque necessary for the straightening is transmitted to each of the fixed roller and the movable rollers. Keys 14 and 15 are provided in numbers sufficient to withstand the shearing force applied when transmitting the required torque, and are arranged in a manner shown, for example, in FIG. 2. A sleeve pressing hollow shaft 16 is disposed around the support shaft 13, so that when the second sleeve 12 is axially moved while being guided by the coupling and guiding key 15, the first sleeve 11 is not moved together with the second sleeve 12. The sleeve pressing hollow shaft 16 has one end abutted against an end face of the first sleeve 11, and another end fixed by a pressing nut 17 screwed to the support shaft 13.

The fixed roller 6*a* is coupled to the first sleeve 11 by keys 18, and the movable rollers 7*a*, 7*b* and 7*c* are coupled to the second sleeve 12 by keys (not shown).

Disposed around the sleeve pressing hollow shaft 16 is a sleeve shaft 26 which extends through central portions of a frame 24 and an electric motor 23. Shaft 26 is rotated in synchronism with the motor, and has one end connected to the motor 23 and another end coupled to a screw sleeve 25.

The screw sleeve 25 is rotatably arranged around the sleeve pressing hollow shaft 16 via a bearing 27, and has a thread formed on an outer surface thereof, on which a movable nut 28 is fitted.

The movable nut 28 is contained in a bearing housing 29 and integrally secured thereto by screws 34. The bearing housing 29 is received in a support box 21 such that a relative rotation is inhibited by a screw 30 but a relative sliding motion in the direction of arrow 40 is permitted.

The support box 21 is provided with a rotation preventing key 20 such that a rotation thereof relative to the frame 19 of the straightener is prohibited. Support box 21 has one end coupled to a cover 22 and another end coupled to the frame 24 to which the electric motor 23 is attached.

Accordingly, if the electric motor 23 rotates, the screw sleeve 25 is simultaneously rotated via the sleeve shaft 26. The movable nut 28 is not rotated because the nut 28 is in engagement with the frame 19 of the straightener through the screw 34, bearing housing 29, screw 30, support box 21, and key 20. The movable nut 28 is coupled to the second sleeve 12 via the bearing housing 29 and a thrust bearing 32.

Therefore, as the motor 23 rotates, the screw sleeve 25 is rotated, whereby the movable nut 28 and thus the second sleeve 12 are moved in the axial direction, thereby permitting the distance between the fixed roller 6*a* and the movable roller 7*a* to be varied.

The driving power source for the driving device is not limited to an electric motor, and may be other means which produces a rotary force.

In the above embodiment is described a case in which the roller width adjusting means is attached to the spindle 10 of an existing straightener and thus a support shaft 13 is indispensable. The support shaft 13 may, of course, be formed integrally with the spindle 10 as one piece.

Next, the operation of adjusting the distance between the fixed roller 6*a* and the movable roller 7*a* will be described.

In the case of a straightener provided with three movable rollers, the roller width is adjustable over a range of (B−S) to (B+2P), as shown in FIG. 3, where P is the roller pitch, and S is the stroke. The amount of movement of the movable rollers is thus smaller than when using only one movable roller. By changing the widths of spacers 33 provided between the movable rollers 7*a*, 7*b* and 7*c* as needed, it is possible to vary the distances between the rollers.

Referring to FIG. 1, when a web height h of an H-beam is instructed by a host computer, a suitable one of the movable rollers 7*a*, 7*b* and 7*c* to be used is selected. Namely, roller 7*a* is selected when $B-S \leqq h \leqq B$;
roller 7*b* is selected when $B < h < B+P$; and
roller 7*c* is selected when $B+P \leqq h \leqq B+2P$.

Then, to set the roller width to h, the electric motor 23 is driven, for example, when $h < B$, to reduce the roller width by B−h, whereby the sleeve shaft 26 coupled to the electric motor 23 and thus the screw sleeve 25 coupled to the sleeve shaft 26 are rotated. In this case, the sleeve pressing hollow shaft 16, the support shaft 13, and the spindle 10 remain stationary. The screw sleeve 25 engages with the movable nut 28, which in turn is fixed to the bearing housing 29 by the screw 34. The screw housing 29 is fixed to the support box 21 by the screw 30, whereby the movable nut 28 and the bearing housing 29 are moved in the direction of arrow 40 in FIG. 1. The bearing housing 29 is coupled, via the thrust bearing 32, to the second sleeve 12 on which the movable rollers 7*a*, 7*b* and 7*c* are mounted. Accordingly, the second sleeve 12 is similarly moved in the direction of arrow 40. The amount of such movement is detected by a movement sensor 36 attached to the frame 19, which contacts the bearing housing 29 and is always moved together therewith. Upon detecting a movement by a required distance, the sensor 36 outputs a signal to the electric motor 23 to stop same. In the case of $B < h$, the electric motor 23 is rotated in a reverse direction to move the second sleeve 12 in a direction opposite to that of the allow 40 (i.e., leftward).

Figure 4:
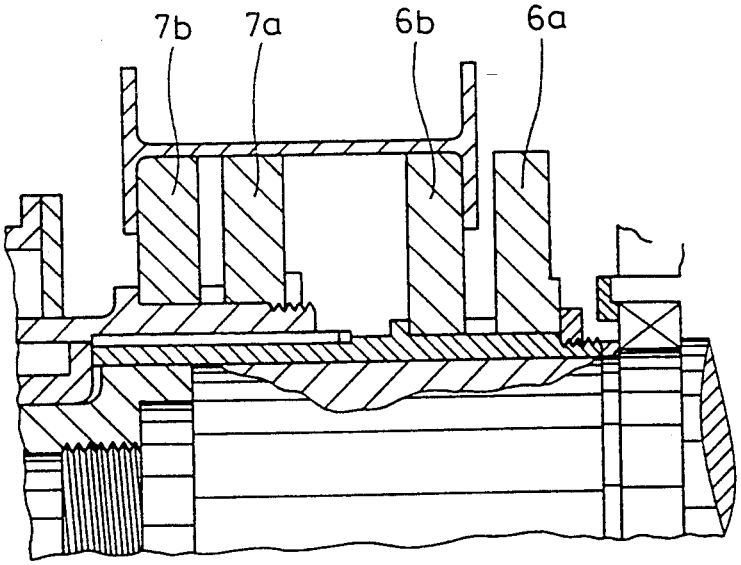
FIG. 4 is a diagram showing another embodiment of this invention.
Figure 5:
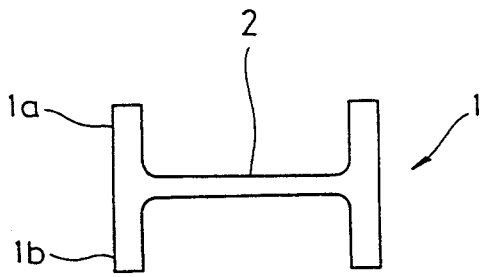
FIG. 5 is a sectional view of an H-beam.
Figure 6:
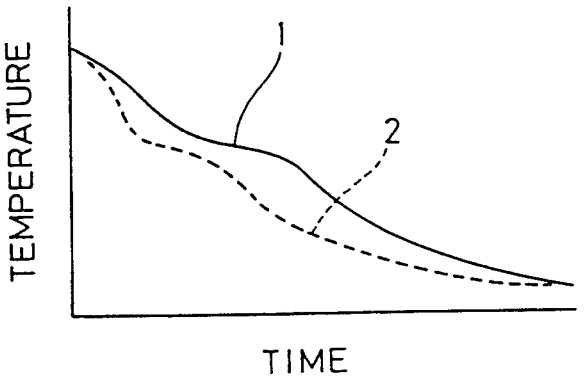
FIG. 6 is a graph showing H-beam cooling rates.
Figure 7A:
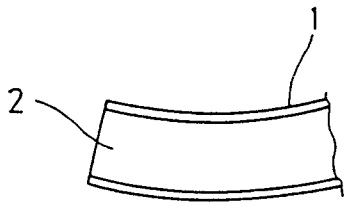
FIGS. 7(*a*) to 7(*c*) are diagrams showing deformation of an H-beam, i.e., bending, warp, and angular deformation, respectively.
Figure 7B:
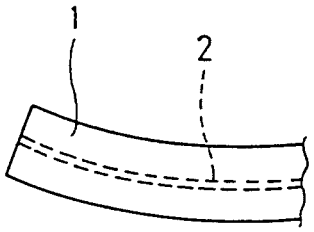
Figure 7C:
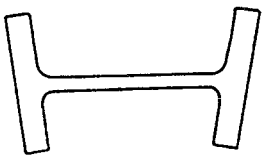

The above description is based on an arrangement in which a single fixed roller and a plurality of movable rollers are used, but conversely, a plurality of fixed rollers and a single movable roller may be provided. Further, as shown in FIG. 4, both the fixed roller and the movable roller may comprise a plurality of rollers 6*a*, 6*b* and 7*a*, 7*b*, in which case, the amount of movement of the movable rollers can be reduced as in the above-described case.

According to this invention, the following advantages can be achieved:

(1) In conventional apparatuses, the roller width adjustment is effected by disassembling and assembling the rollers in accordance with the inner width of an H-beam, and since H-beams with the same external dimension include a plurality of types according to different flange thicknesses, the roller width adjustment involving the adjustment of the rollers in accordance with the flange thickness must be frequently carried out. According to this invention, an on-line roller with adjustment can be effected in a short time, thereby increasing the productivity.

(2) An operator need not perform a complex roller width adjustment involving disassembling and assembling of the rollers, which is required in the prior art.

(3) To change the roller width, only one driving device for driving the movable roller is required, and it is unnecessary to provide an additional driving device for driving the fixed roller, whereby the cost of equipment is reduced.

While this invention has been described in conjunction with specific embodiments thereof, it is evident that many alternatives, modifications and variations will be apparent to those skilled in the art. For example, section steel other than H-beam could be straightened with the straightening rollers of the present invention, and the plurality of rollers (7*a* to 7*c* in FIG. 1) could be a number other than three. Accordingly, the preferred embodiments of the invention as set forth herein are intended to be illustrative, not limiting. Various changes maybe made without departing from the spirit and scope of the invention as defined in the following claims.

What is claimed is:

1. A section steel straightener, having an adjustable width roller in which a fixed roller and a movable roller having an identical outer diameter are coaxially juxtaposed in an axial direction of the apparatus, comprising:

a spindle for rotating the fixed roller and the movable roller;

a first sleeve, which is disposed around the spindle with a coupling key therebetween and on which the fixed roller is mounted, for transmitting driving torque from the spindle to the fixed roller;

a second sleeve, which is disposed around the first sleeve with a coupling and guiding key therebetween and on which the movable roller is mounted, for transmitting the driving torque from the spindle to the movable roller;

a sleeve pressing hollow shaft disposed around a support shaft extending from one end of the spindle, for prohibiting a movement of the first sleeve in the axial direction;

a screw sleeve rotatably disposed around the sleeve pressing shaft and having a thread formed on a surface thereof;

a movable nut having rotation preventing means screwed to the screw sleeve, and coupled to one end of the second sleeve; and a rotating device for rotating the screw sleeve, to move the second sleeve back and forth in the axial direction via the movable nut and the coupling and guiding key.

2. A section steel straightener according to claim 1, wherein at least one of said fixed roller and said movable roller comprises a plurality of rollers.

* * * * *